US005865602A

United States Patent [19]

Nozari

[11] Patent Number: 5,865,602

[45] Date of Patent: Feb. 2, 1999

[54] AIRCRAFT HYDRAULIC PUMP CONTROL SYSTEM

[75] Inventor: Farhad Nozari, Newcastle, Wash.

[73] Assignee: The Boeing Company

[21] Appl. No.: 977,927

[22] Filed: Nov. 24, 1997

Related U.S. Application Data

[63] Continuation of Ser. No. 404,397, Mar. 14, 1995, abandoned.

[51] Int. Cl.[6] ..... F04B 49/06

[52] U.S. Cl. ..... 417/44.1; 417/44.2; 417/43; 417/53; 417/212; 60/449; 60/911

[58] Field of Search ..... 417/42, 43, 44.1, 417/44.2, 44.11, 45, 53, 212, 213; 60/431, 449, 911

[56] References Cited

U.S. PATENT DOCUMENTS

| | | | |
|---|---|---|---|
| 3,667,225 | 6/1972 | Karman | 60/911 |
| 3,744,243 | 7/1973 | Faisandier | 60/431 |
| 4,023,637 | 5/1977 | Jackovich | 180/6.48 |
| 4,091,617 | 5/1978 | Cornell | 60/445 |
| 4,474,104 | 10/1984 | Creffield | 91/497 |
| 4,485,623 | 12/1984 | Chichester et al. | 60/422 |
| 4,510,750 | 4/1985 | Izumi et al. | 60/443 |
| 4,523,892 | 6/1985 | Mitchell et al. | 417/34 |
| 4,667,472 | 5/1987 | Clay et al. | 60/387 |
| 4,790,233 | 12/1988 | Backe et al. | 91/361 |
| 4,854,164 | 8/1989 | Rhoads | 417/44.1 |
| 4,918,918 | 4/1990 | Miki et al. | 60/489 |
| 5,103,671 | 4/1992 | Dyvig | 73/168 |
| 5,141,402 | 8/1992 | Bloomquist et al. | 417/22 |
| 5,181,837 | 1/1993 | Niemiec | 417/350 |
| 5,286,171 | 2/1994 | Murota et al. | 417/42 |
| 5,320,499 | 6/1994 | Hamey et al. | 417/218 |

*Primary Examiner*—Meng-Al T. An
*Assistant Examiner*—Xuan M. Thai
*Attorney, Agent, or Firm*—Conrad O. Gardner

[57] ABSTRACT

A control system for an aircraft's electrically driven hydraulic pump. An electronic motor controller having closed loop feedback is utilized to directly control the prime mover speed in response to pump loading.

2 Claims, 5 Drawing Sheets

Fig. 1.
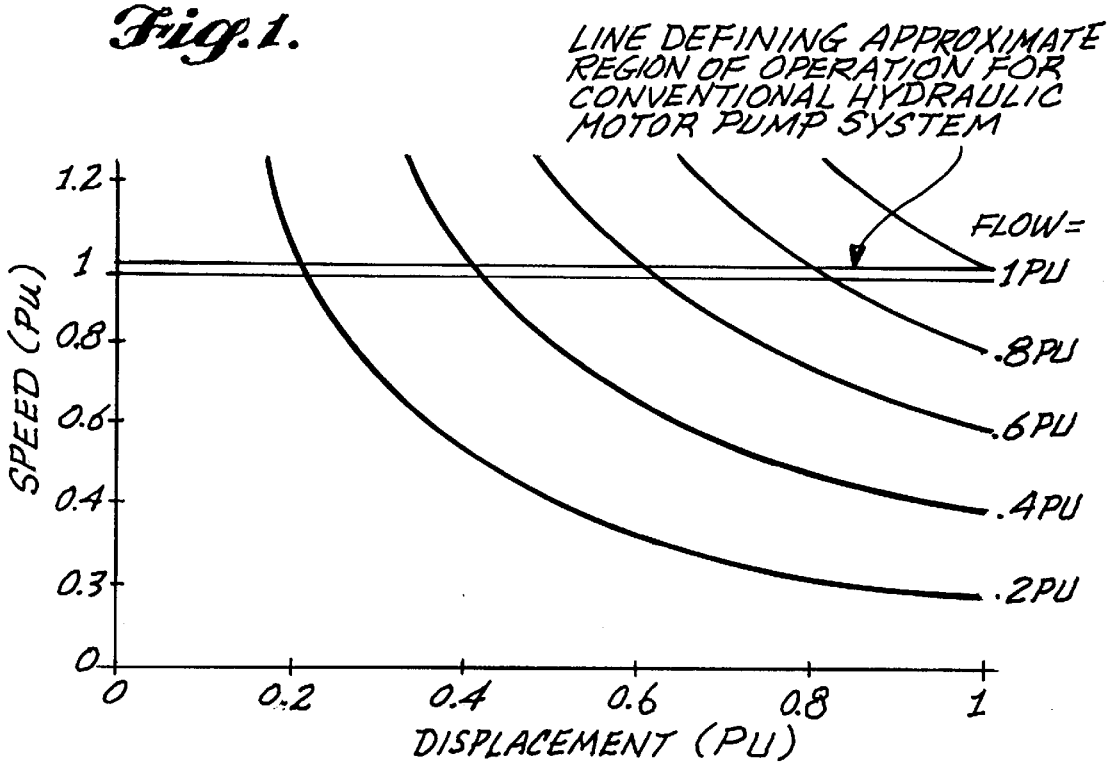
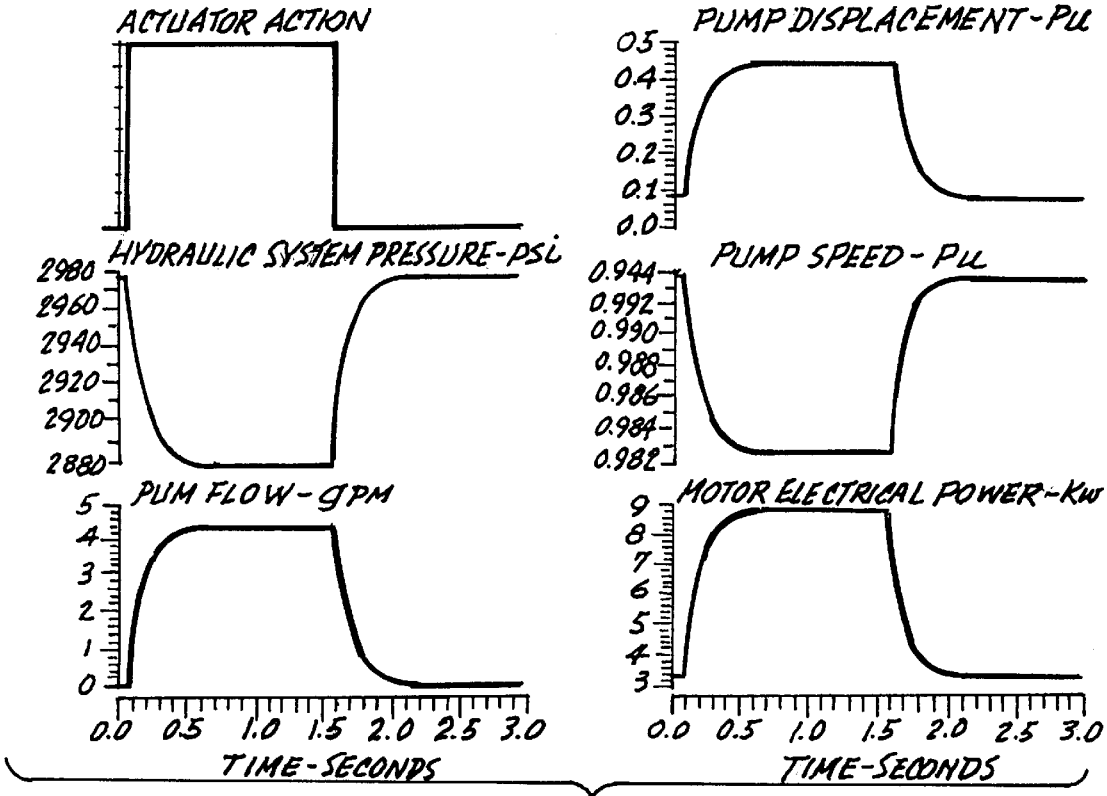
Fig. 2.

Fig. 7.
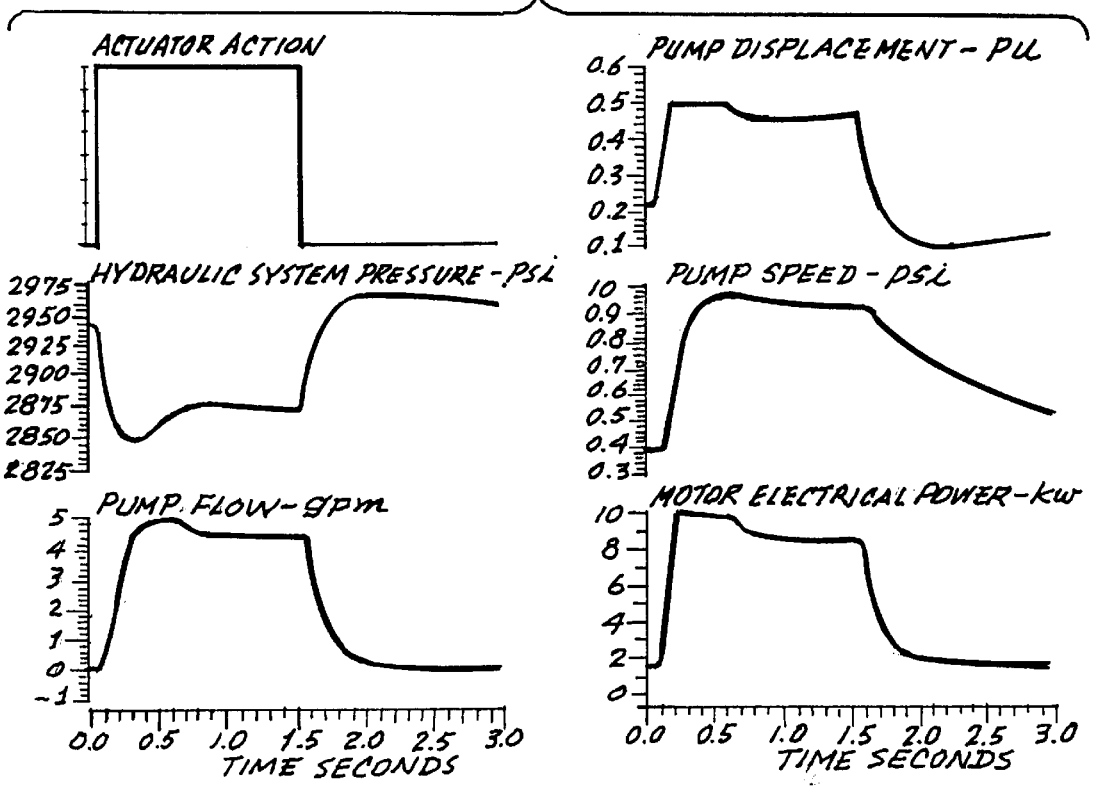
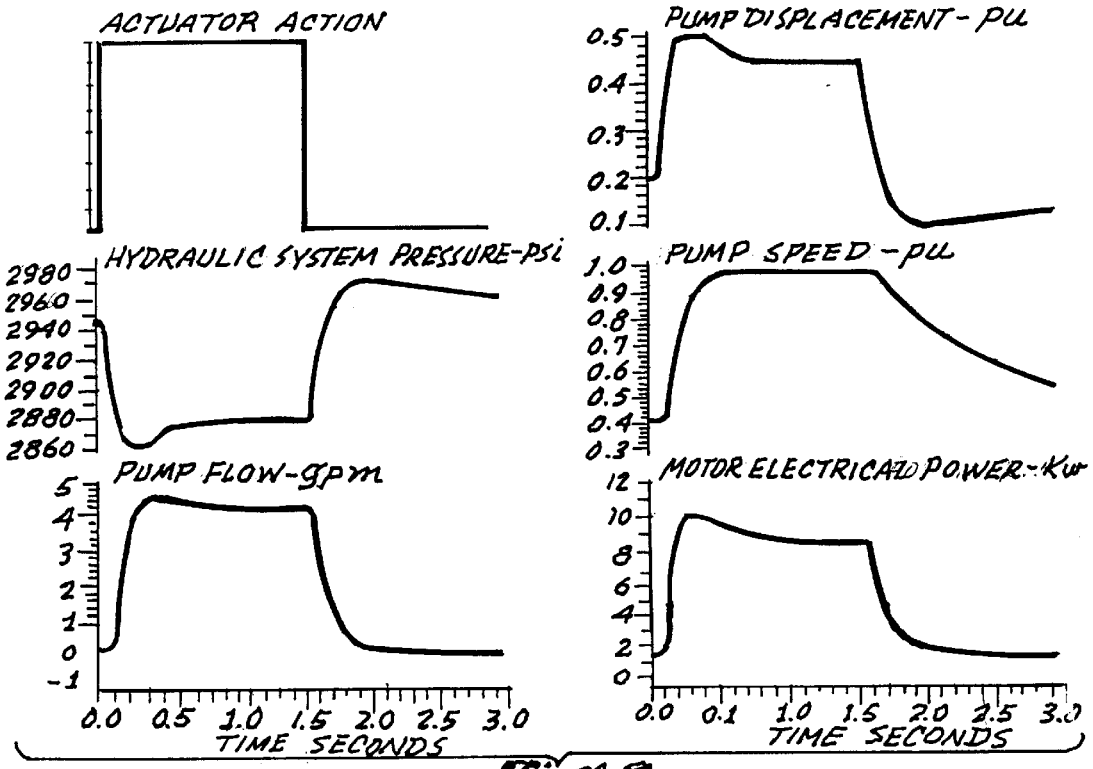
Fig. 8.

AIRCRAFT HYDRAULIC PUMP CONTROL SYSTEM

This application is a file wrapper continuation of prior application No. 08/404,397, filed Mar. 14, 1997, now abandoned.

BACKGROUND

This invention relates to aircraft electrically driven hydraulic pumps and more particularly to control systems for electrically driven hydraulic pumps.

PRIOR ART PATENT LITERATURE

U.S. Pat. No. 5,320,499 to Hamey et al, shows an open-loop hydraulic supply system where a control apparatus has an AC electromagnetic adjustment means for adjusting the operating range of the secondary mover. A drive means is provided to drive the adjustment means with an AC signal having a frequency which is proportional to the speed of the prime mover.

U.S. Pat. No. 4,523,892 to Mitchell et al, discloses a hydrostatic vehicle control which controls pump displacement of a variable displacement hydraulic pump and the quantity of the fuel delivered to an internal combustion engine to maintain a highly efficient operating point.

U.S. Pat. No. 3,826,097 to Tone, pertains to a variable speed hydrostatic drive and includes a first prime mover having a first adjustable control means for varying the speed of the prime mover, a first reversible and adjustable fluid pump which is driven by the prime mover and has a second adjustable control means for varying the fluid displacement of the pump, a first hydraulic motor hydraulically connected to the pump for driving the load at speeds related to the speed of the motor. A master control means is connected to the first and second control means to adjust the speed of the prime mover and displacement of the pump.

U.S. Pat. No. 3,744,243 to Faisandier, relates to a control system which controls the capacity of a variable pump in response to the pressure in the conduits which couple the pump to the fluid driven motor.

PRIOR AIRCRAFT HYDRAULIC SYSTEMS

Conventional commercial airplane hydraulic systems utilize engine driven hydraulic pumps to maintain a system pressure of approximately 3,000-psi, while electric motor-pumps act as backup hydraulic sources. Present airplane electrical systems are constant-voltage/constant-frequency (115-VAC/400-Hz) systems. Supplying this fixed voltage/frequency to electric motor-pumps results in their inefficient operation due to the fact that they would rotate at a high speed while they normally operate at very little load which does not require such high speed operation.

CONTROL PRINCIPLES

Conventional airplane hydraulic systems utilize a number of combined electric induction motor/hydraulic pump units as sources of backup hydraulic power. To regulate the system hydraulic pressure, the pressure is sensed, and should the value fall significantly below the reference value of approximately 3,000-psi, a swashplate action in the hydraulic pump would increase the pump displacement. This results in an increased flow to the hydraulic system and restoration of system pressure back to its nominal value. Conversely, if hydraulic pressure increases above the reference value, the swashplate in the pump would decrease the pump displacement and flow. The swashplate mechanism provides agile transient response and good steady-state control of the system. FIG. 1 indicates the approximate portion of the hydraulic pump speed vs. displacement curve on which the conventional system operates. FIG. 2 shows a typical transient response for this type of system. The upper left trace of FIG. 2 shows that a load is applied to the hydraulic system at t=0.05-seconds. In response to the resulting pressure drop, pump displacement and flow are increased by the swashplate to maintain the system pressure. Pump speed, and the electrical power consumed by the motor are also displayed. At t=1.55-seconds the load is removed from the hydraulic system causing the system pressure to rise. As a result, the swashplate reduces the pump displacement and flow to maintain system pressure near the reference value of approximately 3,000-psi.

There is a major problem associated with this conventional method of control. That is, the induction motor which drives the hydraulic pump is continually supplied from a 115-VAC, 400-Hz source. Hence, the induction motor and pump operate at essentially a constant speed, only slightly changed by the system loading. Approximately 80 to 90% of the time the motor-pumps are minimally loaded. Therefore, the induction motor operates at a point of low efficiency, and the hydraulic pump turns at a high speed (typically about 6,000-RPM) which results in high noise and reduced pump life.

It is accordingly an object of the present invention to incorporate a motor controller into an aircraft hydraulic motor-pump system (between the electrical supply system and the hydraulic motor) so that the motor-pump may operate at a low speed when its demand is low. It is a further object of the present invention to provide a method of control for the motor-pump utilizing a variable displacement pump and a variable speed motor.

Another problem is the severe transient that the induction motor imposes on the electrical supply system upon start-up. Induction motor starting currents range from four to six times rated current until the motor comes up to speed, causing a significant depression in the system voltage. Presently, relays are incorporated into the electric system to allow staggered starting of these electric motor-pumps from a single source. These additional relays have a negative impact on system reliability and maintainability.

The present invention since it utilizes a motor-controller would be capable of soft starting the motor-pump hence avoiding the above high starting currents. Moreover, a favored feature of the invention is its compatibility with a variable frequency power system.

SUMMARY OF THE INVENTION

In summary, the invention provides a new method of control of an aircraft's electrically driven hydraulic pump. The proposed system utilizes a variable speed induction motor with a correspondingly variable frequency controller and a conventional aircraft variable displacement hydraulic pump. The motor is driven at reduced speed when demand is low to extend the motor and pump lives. The variable displacement pump permits the use of a control method which provides rapid response to sudden changes in demand.

BRIEF DESCRIPTION OF THE DRAWINGS

FIG. 1 is a diagram illustrative of the portion of the hydraulic pump speed vs. displacement curve operational region of prior systems;

FIG. 2 is a diagram illustrative of the typical transient response of prior systems;

FIG. 7 shows graphs illustrative of variable swashplate fast dynamic response during both load application and removal for the first embodiment control system of the present invention shown in FIG. 4; and, FIG. 8 shows graphs illustrative of variable swashplate fast dynamic response during both load application and removal for the second embodiment control system of the present invention shown in FIG. 5.

DETAILED DESCRIPTION OF THE DRAWINGS

Alternative Approaches to Hydraulic Motor-Pump Control

A suitable control approach would involve operating the motor-pump at a reduced speed when it is lightly loaded (low-flow conditions). This would increase the motor efficiency and pump life while reducing pump noise.

This could he accomplished by introducing a motor controller between the electrical power supply system and the input to the induction motor. At low-flow conditions, the electric motor-pump would be supplied with conditioned power from the motor controller which would drive the electric motor-pump at a low speed. The motor-pump losses and the hydraulic pump noise would decrease, and hydraulic pump life would increase significantly.

During high flow conditions the electric motor-pump would operate at higher speeds to meet the system requirements. The speed increase would be due to a change in the conditioned power supplied to the motor by the motor controller.

Two possible approaches to electric motor-pump control are described hereinafter. The Fixed Displacement Hydraulic Pump/Variable Speed Motor describes a control technique using a fixed displacement hydraulic pump with a variable speed motor. The Variable Displacement Hydraulic Pump/Variable Speed Motor describes first and second embodiments of the proposed control technique using a variable displacement pump and a variable speed motor. Comparison of these methods shows that the fixed-displacement pump/variable-speed motor has significant operational problems, while either version of the variable-displacement pump/variable-speed motor offers the best solution.

Fixed Displacement Hydraulic Pump/Variable Speed Motor

Figure 3:
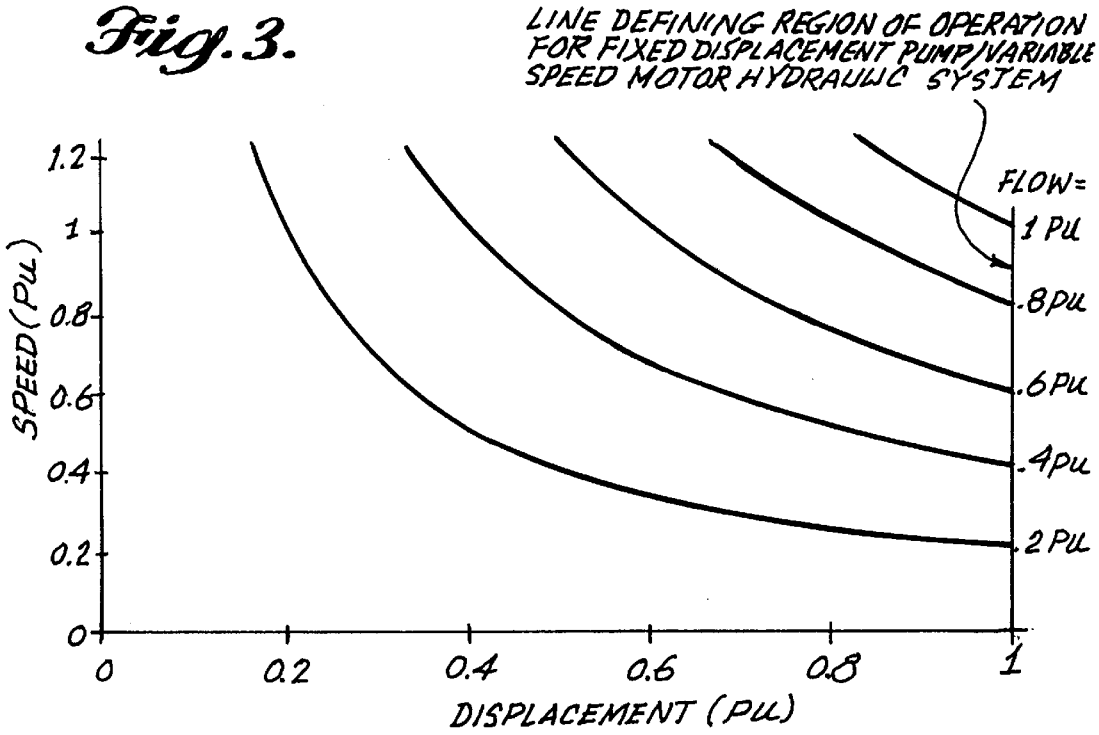
FIG. 3 is a diagram illustrative of the portion of the hydraulic pump speed vs. displacement curve of operation of a possible method for controlling the motor-pump where the position of the swashplate is fixed and therefore the pump flow is a function of motor speed only.

One possible method to control the motor-pump would be to fix the position of the swashplate in the hydraulic pump and, therefore, make the pump flow a function of motor speed only. FIG. 3 indicates the portion of the hydraulic pump speed vs. displacement curve on which this system would operate. This could be made to satisfy the steady-state flow requirements. However, this approach has some serious problems as described below.

The first item of concern is that operating a fixed displacement pump into a fixed pressure system will require the electric motor to supply rated torque, hence, to draw rated current at all times. This may result in excessive heat and stress in the motor and its controller.

A second item of concern is that when very low flow is required by the system the motor speed would be very low (<5–10%). As a result, hydraulic is fluid may not provide enough wetness to the hydraulic pump, preventing the buildup of a film thick enough for adequate lubrication. This may cause degradation of the pumps life and operational characteristics.

Another factor against this method of control deals with the dynamic response of the system. Prior systems are able to respond quickly to hydraulic system pressure variations due to the fact that it involves only the movement of a small swashplate. However, a hydraulic pump with a fixed swashplate can only change flow rate via a change in motor-pump speed. The motor-pump combination represents a relatively large inertia which translates into a sluggish transient response.

A further problem related to this type of control occurs when a rapid decrease in flow is commanded by the system. This may be achieved by quickly slowing the motor-pump combination. However, this represents a significant reduction of the motor-pumps kinetic energy in a short amount of time. This rotational energy is converted to regenerative electrical form which then flows into the motor controller. This stresses components in the motor controller which may require an increase in its size/weight or result in component failure.

Variable Displacement Hydraulic Pump/Variable Speed Motor

Control system embodiments according to the proposed method involve a combination of a variable displacement pump and a variable speed motor. A motor controller is again required to control the speed of the motor, however, the flow is also a function of swashplate position which is not fixed.

Figure 4:
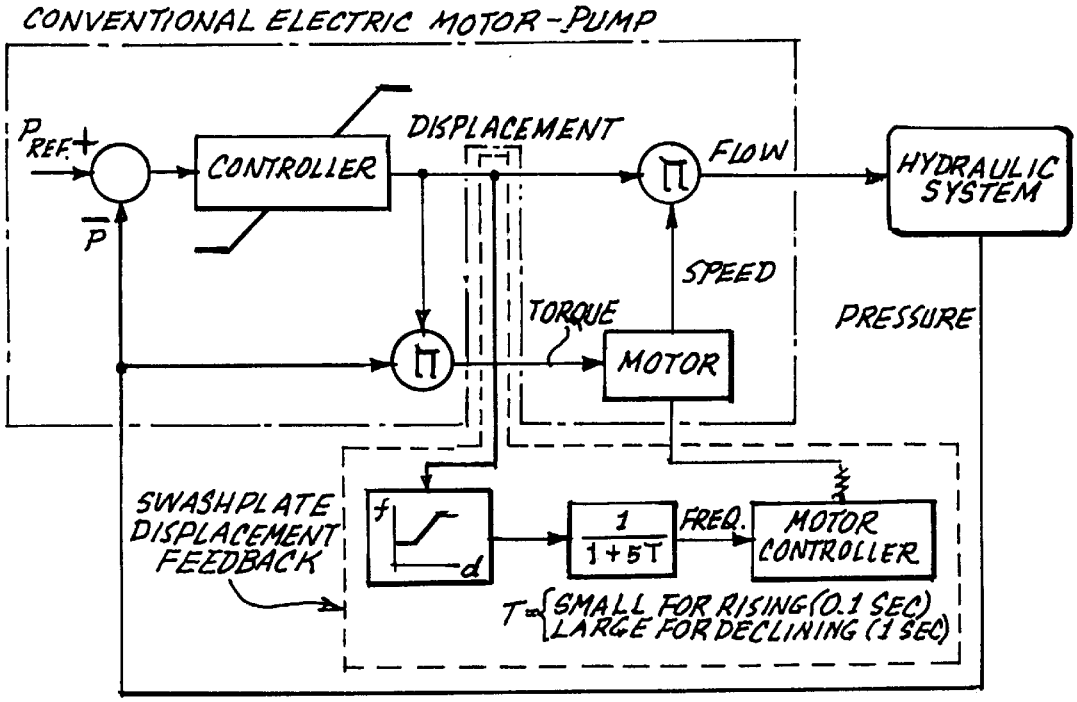
FIG. 4 is a block diagram of a first embodiment of the proposed control system utilizing swashplate displacement as an element in the feedback system.
Figure 5:
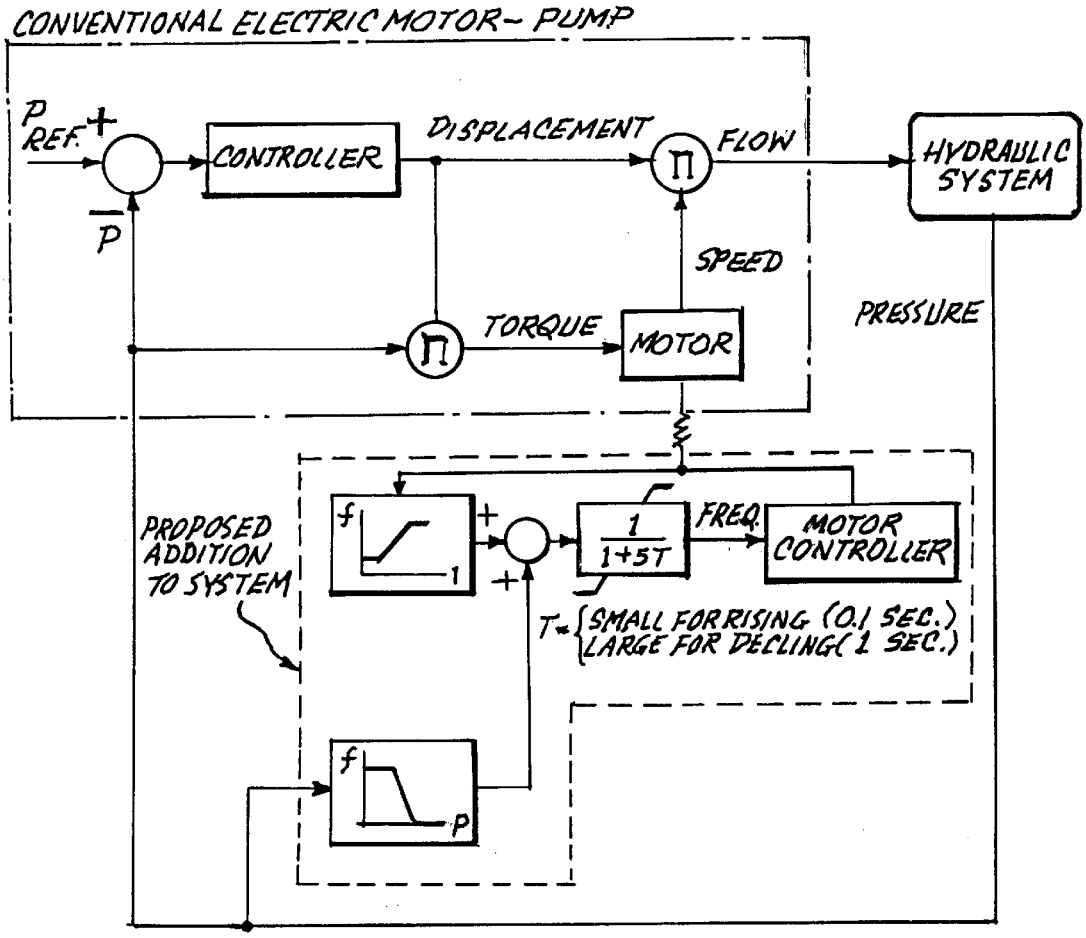
FIG. 5 is a block diagram of a second embodiment of the proposed control system utilizing motor current in the feedback loop.

This method overcomes all of the problems identified for the fixed-displacement/variable-speed motor control hereinabove discussed, and provides transient response comparable to that of the prior hydraulic system. Block diagrams for the first and second embodiments of the present control system are shown in FIGS. 4 and 5 respectively. Swashplate displacement is used as an element in the feedback system for the first embodiment in FIG. 4, while the use of motor current in the feedback loop is featured in the second embodiment shown in block diagram in FIG. 5.

In the second embodiment shown in FIG. 5 when the motor current, or equivalently the motor controller current is used as the primary feedback signal, an additional pressure feedback would be required to ensure high speed, hence high flow, operation of the motor-pump for severely depressed system pressure. Without this loop, the current loop would not quickly increase the pump speed and flow to restore system pressure since the input power to motor would also be low due to depressed system pressure. Also note that for nominal hydraulic system pressure, the presser loop would be inactive.

Figure 6:
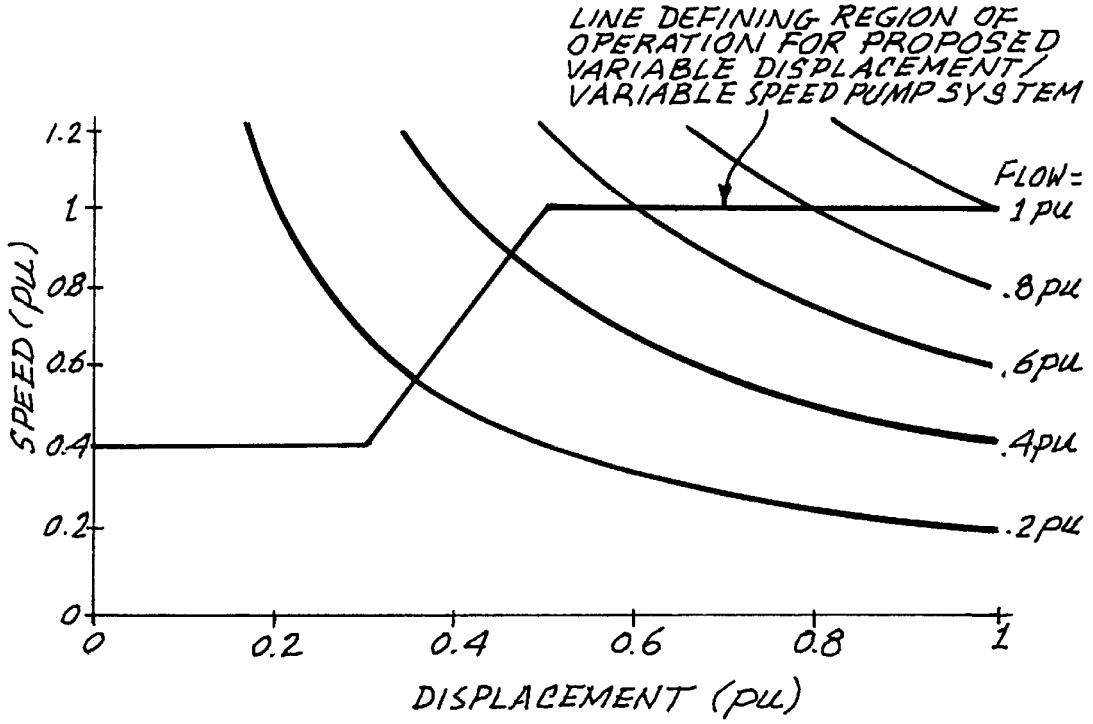
FIG. 6 is a diagram showing the portion of the hydraulic pump speed vs. displacement curve of operation for the first embodiment of the proposed control system shown in FIG. 4.

FIG. 6 indicates the portion of the hydraulic pump speed vs. displacement curve on which the system would operate for the first embodiment. The speed vs. current curve, which would characterize operation of the second embodiment, would have a very similar form. The speed/displacement curve shown is illustrative, however for an actual system, the curve is designed in accordance with hydraulic systems requirements and the pumps capability. When the hydraulic system requires a high fluid flow, the motor would operate at a high speed and the pumps swashplate position would be at full displacement. System operation would then be confined to the upper right hand region of the curve in FIG. 6. On the other hand, for the majority of the time the required pump flow is very low, thus the motor speed can be reduced, as can the pump displacement. The system would then operate in the lower left portion of the curve in FIG. 6.

For both embodiments of control, the operation of the motor-pump over the region of low speed has advantages over that for the fixed displacement system herein above described. At low flow the motor speed is selected so as to provide sufficient wetness to the hydraulic pumps for full-film lubrication. Also, the motor current is no longer required to be near its rated value irrespective of the flow requirement as is the case for fixed displacement pumps. The swashplate action ensures that the motor-pump would be unloaded during low flow conditions. The motor and pump can therefore operate at a low speed without the motor having to supply a high torque against the system pressure.

A unique feature of the present control system is that it takes advantage of the, variable swashplate to provide fast dynamic response during both load application and removal. This is demonstrated by computer simulation results shown in FIGS. 7 and 8 for the first and second embodiments respectively. Prior to load application the motor is assumed to be running at approximately 40% speed, and the swashplate is at a low value of displacement. Operation is in the lower left hand region of FIG. 6. When flow is demanded, the swashplate quickly moves to increase pump flow to maintain system pressure. Meanwhile, the motor speed increases at a somewhat slower rate and eventually reaches an optimum value. Coordination between the motor speed and swashplate position automatically occurs during the motors speed increase to maintain system pressure and flow.

Similarly, when flow demand increases, the swashplate rapidly moves to a position consistent with the flow requirements while the motor speed decreases at a much slower rate. This gradual decrease in motor speed precludes regenerative energy problems which occur for the fixed displacement system. Changes in motor speed and swashplate position is again automatically coordinated to achieve proper operation on the lower left portion of the speed vs. displacement curve. As the simulation results indicate, the motor-pump transient performance is very close to that for the prior system shown in FIG. 2.

An added advantage of using a motor controller is that starting an electric motor-pump would no longer result in a high starting current. The motor controller would allow the induction motor to accelerate via a "soft startup" with a negligible impact on the electrical power system. Starting of multiple motors from a single source would then not require additional components to control the starting sequence of the motors in the system.

As seen from the preceding, the present control system embodiments maintain good transient and steady-state system performance.

What is claimed is:

1. A pressure regulated hydraulic supply system of an aircraft comprising:

a variable displacement swash pump comprising a swash plate for regulating system pressure;

a variable speed electric motor for driving said variable displacement swash pump;

control circuit means for controlling said variable displacement swash pump to displace said swash plate in response to system demand;

sensing means for sensing a displacement of said swash plate;

said control circuit means driving said variable speed electric motor at a speed responsive to said sensed displacement of said swash plate; and said control circuit means controlling the speed of said variable speed electric motor in a continuous and gradual manner in response to said sensed displacement of said swash plate, wherein the speed of said variable speed electric motor is increased or decreased at a rate slower than a rate at which said swash plate is being displaced.

2. A method for operating a hydraulic supply system of an aircraft including a variable displacement swash pump having a swash plate, said variable displacement swash pump driven by a variable speed electric motor, comprising the steps of:

operating said variable speed electric motor at high speed with said swash plate at full displacement when said hydraulic supply system requires a high fluid flow for maintaining system pressure;

reducing said variable speed electric motor speed and said swash plate at reduced displacement when said hydraulic supply system requires a low pump flow;

sensing said swash plate displacement; and controlling the speed of said variable speed electric motor in a continuous and gradual manner in response to said sensed swash plate displacement, wherein the speed of said variable speed electric motor is increased or decreased at a rate slower than a rate at which said swash plate is being displaced.

* * * * *